US006886427B2

(12) United States Patent
McVicar

(10) Patent No.: US 6,886,427 B2
(45) Date of Patent: May 3, 2005

(54) FLOOR LOCK FOR FOOT-OPERATED DEVICE

(75) Inventor: David McVicar, El Dorado, CA (US)

(73) Assignee: Logitech Europe S.A., Romanel-sur Morges (CH)

( * ) Notice: Subject to any disclaimer, the term of this patent is extended or adjusted under 35 U.S.C. 154(b) by 0 days.

(21) Appl. No.: 10/150,542

(22) Filed: May 17, 2002

(65) Prior Publication Data

US 2003/0213333 A1 Nov. 20, 2003

(51) Int. Cl.[7] ..... G05G 1/14
(52) U.S. Cl. ..... 74/560; 74/512; 74/564
(58) Field of Search ..... 74/512, 560, 564

(56) References Cited

U.S. PATENT DOCUMENTS 4,991,908 A * 2/1991 Krechel ..... 297/423.41
5,148,152 A * 9/1992 Stueckle et al. ..... 345/156
5,299,369 A * 4/1994 Goldman ..... 36/61
5,334,997 A * 8/1994 Scallon ..... 345/167
5,552,807 A * 9/1996 Hayes et al. ..... 345/157
5,751,274 A * 5/1998 Davis ..... 340/573.4
6,502,905 B2 * 1/2003 Cheris et al. ..... 297/423.46

* cited by examiner

*Primary Examiner*—David A. Bucci
*Assistant Examiner*—Bradley J. Van Pelt
(74) *Attorney, Agent, or Firm*—Townsend and Townsend and Crew LLP

(57) ABSTRACT

Embodiments of the present invention are directed to a dynamic apparatus for locking or stabilizing an input device such as a foot-operated device with respect to the floor. In one embodiment, an input device with a non-permanent floor mount comprises a user manipulable object movably coupled to a body of the input device which is configured to be placed on a floor. The user manipulable object is movable by a user applying a force thereon having a force component in a forward direction along the floor. A floor lock is movably connected to the body of the input device and has a contact surface for engaging the floor to substantially prevent movement of the input device in the forward direction along the floor. The floor lock is configured to move with respect to the body of the input device in a downward direction toward the floor and a rearward direction opposite from the forward direction in response to the force applied by the user on the user manipulable object having the force component in the forward direction along the floor.

23 Claims, 10 Drawing Sheets

FLOOR LOCK FOR FOOT-OPERATED DEVICE

BACKGROUND OF THE INVENTION

This invention relates generally to locking or stabilizing mechanisms and, more particularly, to an apparatus for temporarily locking or stabilizing a device such as a pedal assembly or the like with respect to a floor.

Devices that require a non-permanent floor mounted, foot-actuated interface are prone to unintended movement relative to the operator, thereby interfering with the proper operation of the device. Due to the temporary nature of the floor mounting mechanism, the stability of the device is typically poor. This is problematic for an input device such as a gaming pedal 10, as illustrated in FIG. 1. For instance, the lateral or horizontal force component ($F_{ah}$) of the force $F_a$ (with vertical component $F_{av}$) exerted on the pedal 12 by the operator's foot may be larger than the resisting forces ($F_{rh}$) of the device 10 as provided by the mounting component such as one or more rubber mounting feet 14. This causes the input device 10 to move away from the user, requiring frequent replacement of the device relative to the user's foot and thus loss of control and satisfactory game play.

One difficulty is that these foot-operated devices should be made to function on a variety of different floor surfaces, including carpets that are thick, thin, dense, or loose; and non-carpeted surfaces such as wood, tile, and linoleum surfaces. The use of small rubber feet at the bottom of the foot-operated device cannot resist movement on carpet, and generally cannot adequately resist movement on non-carpeted floor surfaces due to the small surface areas of contact between the rubber feet and the floor surface. A fixed set of ribs or teeth at the bottom of the foot-operated device would provide some retention on a carpet. As the horizontal force increases, however, the ribs or teeth do not further embed themselves and slipping and tearing of the carpet can occur. In addition, the rubber feet would need to be removed for carpet use; otherwise, the rubber feet would cause the teeth to not engage due to the need to avoid interference between the bottom case of the device and the floor if the rubber feet were to function properly.

BRIEF SUMMARY OF THE INVENTION

Embodiments of the present invention are directed to a dynamic apparatus for locking or stabilizing an input device such as a foot-operated device with respect to the floor. The dynamic apparatus translates the horizontal component of the force exerted by the user on the input device through a rotational device that increases the resistive forces by either mechanically engaging teeth of a floor lock into the carpet or generate larger normal (i.e., vertical) forces to increase the frictional resistance to movement of a rubber pad of a floor lock provided at the bottom of the input device with respect to a non-carpeted floor surface.

In accordance with an aspect of the present invention, an input device with a non-permanent floor mount comprises a user manipulable object movably coupled to a body of the input device which is configured to be placed on a floor. The user manipulable object is movable by a user applying a force thereon having a force component in a forward direction along the floor. A floor lock is movably connected to the body of the input device and has a contact surface for engaging the floor to substantially prevent movement of the input device in the forward direction along the floor. The floor lock is configured to move with respect to the body of the input device in a downward direction toward the floor and a rearward direction opposite from the forward direction in response to the force applied by the user on the user manipulable object having the force component in the forward direction along the floor.

In some embodiments, the floor lock is rotatably connected to the body of the input device to rotate in the downward direction and the rearward direction in response to the force applied by the user having the force component in the forward direction. The floor lock may be rotatably connected to the body of the input device by a four-bar linkage, a hinge, or the like. The contact surface of the floor lock may comprise a plurality of teeth, or may comprise a rubber pad. The rubber pad may be removably coupled to the floor lock and is removable to expose another contact surface having a plurality of teeth.

In specific embodiments, the contact surface of the floor lock is initially slanted upward in the forward direction with respect to the floor prior to application of the force having the force component in the forward direction along the floor. The floor lock is rotatable in the downward direction and the rearward direction to position the contact surface more parallel to the floor upon application of the force. The floor lock is rotatable further in the downward direction and the rearward direction to position the contact surface to be slanted downward in the forward direction with respect to the floor upon application of a sufficient amount of the force. The user manipulable object comprises one or more pedals rotatably mounted on the body of the input device along a pedal pivot, and the floor lock is rotatably connected to the body of the input device along a floor lock pivot which is disposed forward of the pedal pivot.

In some embodiments, the floor lock is disposed at least partially in a cavity of the body of the input device in a recessed position, and a latch releasably supports the floor lock in the recessed position and is actuatable to permit the floor lock to move away from the cavity of the body. A biasing member may be coupled with the floor lock to bias the floor lock in the downward direction toward the floor. The user manipulable object comprises a plurality of pedals disposed along a width of the body of the input device, the width extending from a left side to a right side of the body. The floor lock is disposed along the width of the body extending to the left of the plurality of pedals and to the right of the plurality of the pedals. A plurality of floor locks are distributed along a width of the body of the input device, the width extending from a left side to a right side of the body. The floor locks are independently movable with respect to the body of the input device.

In accordance with another aspect of the present invention, an input device comprises a user manipulable object movably coupled to a body of the input device which is configured to be placed on a floor. The user manipulable object is movable by a user applying one or more forces thereon having one or more force components in one or more directions along the floor. A plurality of floor locks each are movably connected to the body of the input device and each have a contact surface for engaging the floor to substantially prevent movement of the input device in the one or more directions along the floor. Each floor lock is configured to move with respect to the body of the input device in a downward direction toward the floor and a resisting direction opposite from one of the one or more directions along the floor in response to the force applied by the user on the user manipulable object having the one or more force components in the one or more directions along the floor.

In some embodiments, each floor lock is rotatably connected to the body of the input device to rotate in the downward direction and the resisting direction in response to the force applied by the user. The plurality of floor locks are rotatable around one or more parallel axes with respect to the body of the input device. The user manipulable object comprises a plurality of pedals disposed along a width of the body of the input device, the width extending from a left side to a right side of the body. The plurality of floor locks are distributed along the width of the body extending to the left of the plurality of pedals and to the right of the plurality of the pedals.

DETAILED DESCRIPTION OF THE INVENTION

Figure 1:
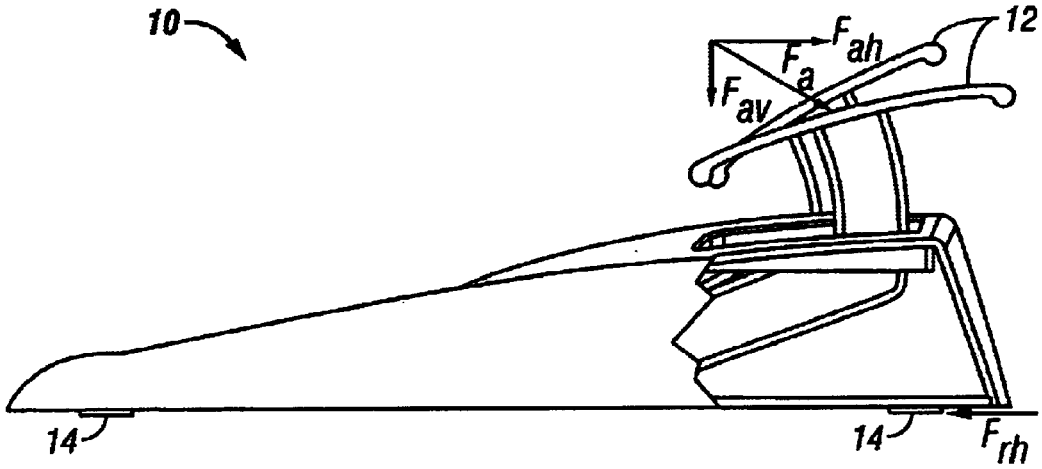
FIG. 1 is an elevational view of a pedal apparatus according to an embodiment of the present invention.
Figure 2:
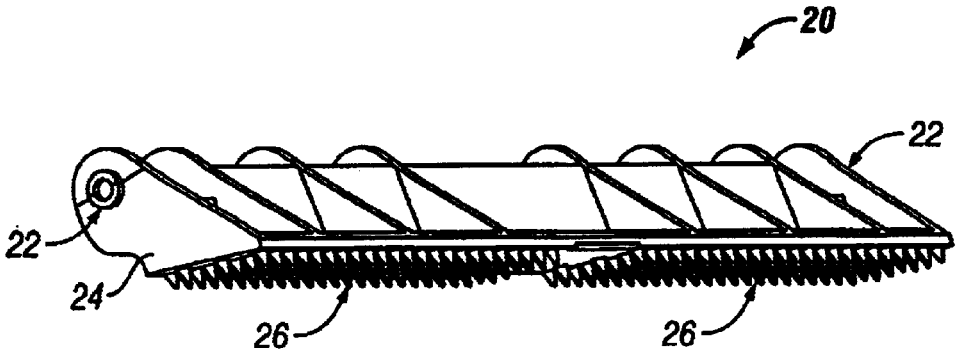
FIG. 2 is a perspective view of a floor lock installed in the pedal apparatus of FIG. 1 according to an embodiment of the present invention.
Figure 3:
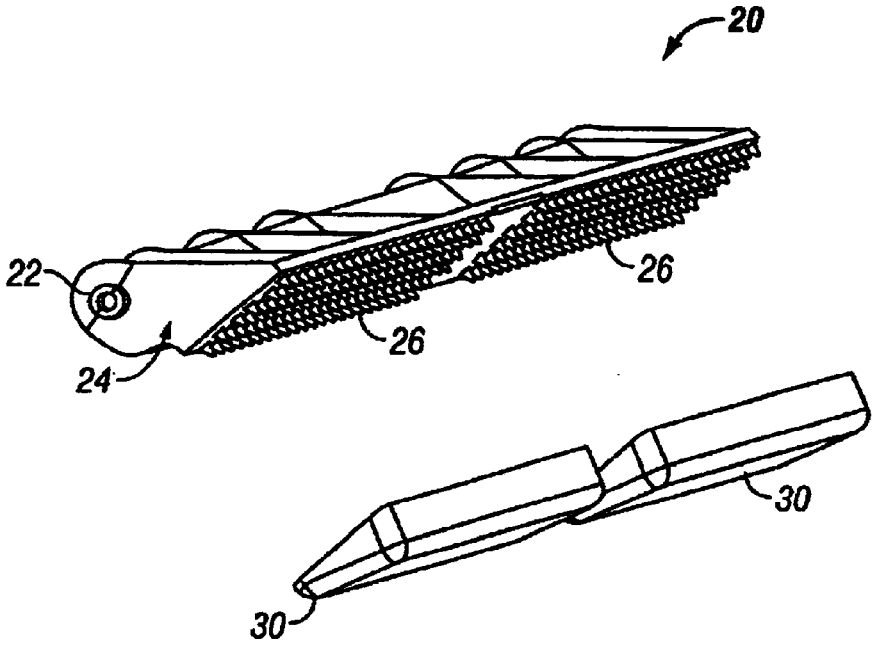
FIG. 3 is an exploded perspective view of the floor lock of FIG. 2 illustrating removable pads according to an embodiment of the present invention.
Figure 4:
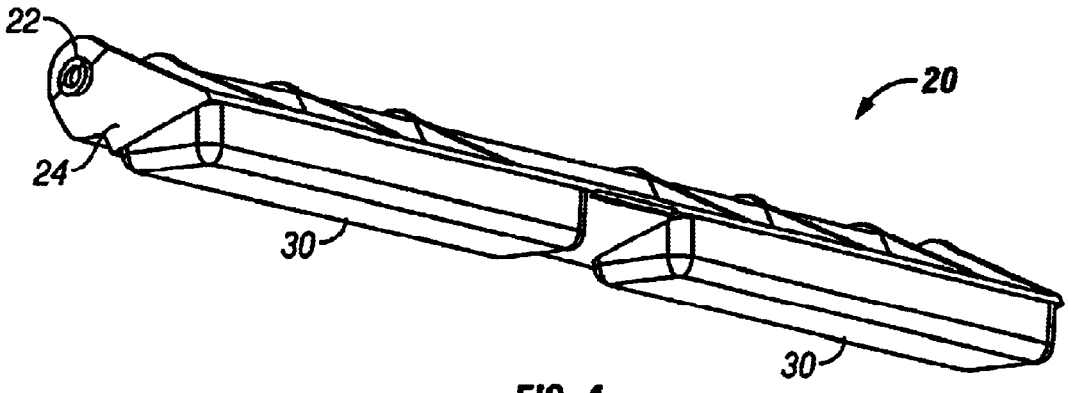
FIG. 4 is a perspective view of the floor lock of FIG. 3 illustrating assembled pads on the floor lock.

FIG. 2 shows a rotational device referred to herein as a floor lock 20 which has off-center hinge points 22 on opposite sides of a longitudinal body and one or more banks of teeth 24 that are disposed at an angle with respect to the hinge points 22. In one specific embodiment, the floor lock 20 includes one or more removable pads 30, typically one pad 30 for each bank of teeth 26, as seen in FIG. 3. The removable pads 30 cover the banks of teeth 26, and are typically made of rubber to be used on non-carpeted floors. FIG. 4 shows the pads 30 installed on the body 24 of the floor lock 20. The pads 30 may be removably connected to the body 24 by an interference fit, by clips, or the like.

Figure 5:
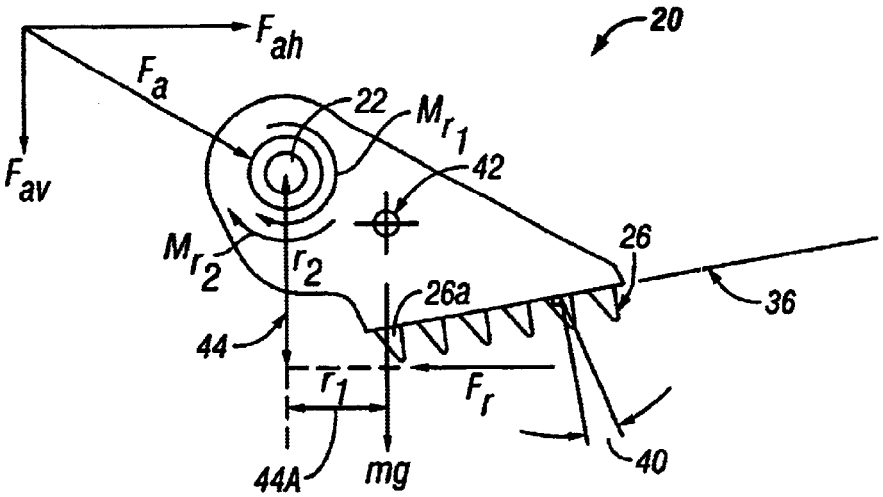
FIG. 5 is a side elevational view of the floor lock of FIG. 2.

The teeth 26 do not extend radially from the hinge points 22 and do not extend vertically downward. As illustrated in FIG. 5, prior to application of a force on the input device 10 by the user, the teeth plane 36 is disposed at an angle relative to the hinge point 22 and is initially slanted upward with respect to the horizontal floor, for instance, by about 10°–15°. The teeth plane 36 is configured to ensure that the row of teeth 26*a* closest to the hinge point 22 engages the carpet floor first. As the force $F_a$ applied to the pedal assembly 10 increases, these leading teeth 26*a* at least substantially prevent slipping relative to the carpet floor and cause the floor lock 20 to "cam" down, forcing the next row of teeth into the carpet floor. As shown in FIG. 5, the force $F_a$ exerted by the user on the pedals 12 is translated to the hinge point 22 of the floor lock 20. The force $F_a$ has a downward component $F_{av}$ toward the floor and a forward component $F_{ah}$ along the floor. The teeth 26 are angled forward relative to the tooth plane 36 and form an angle 40 that defines the angle of attack of the teeth 26 to the carpet surface. The angle 40 typically may range from about 10° to about 25°. As a result, the teeth 26 are not driven perpendicularly into the carpet, but engage at an angle to hook the carpet loops to provide better engagement and locking with the carpet floor. The floor lock 20 has a mass center of gravity at location 42, and a moment arm $r_1$ 44A creating a moment $Mr_l$ that rotates the carpet lock down until it contacts the floor surface. Then, as the user applies force to the pedals, a reactive force, $F_r$, resulting from tooth engagement with the carpet acting through the moment arm $r_2$ 44, creates a moment $Mr_2$ that forces the teeth 26 further into the carpet.

Figure 6:
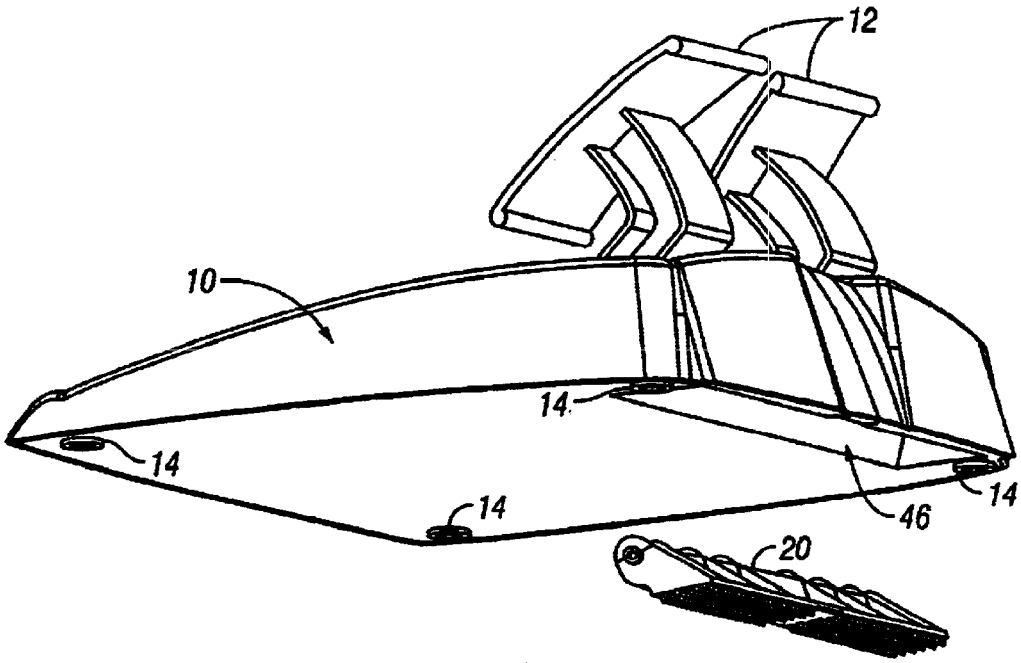
FIG. 6 is an exploded perspective view of the pedal apparatus of FIG. 1 showing a cavity for receiving the floor lock.
Figure 7:
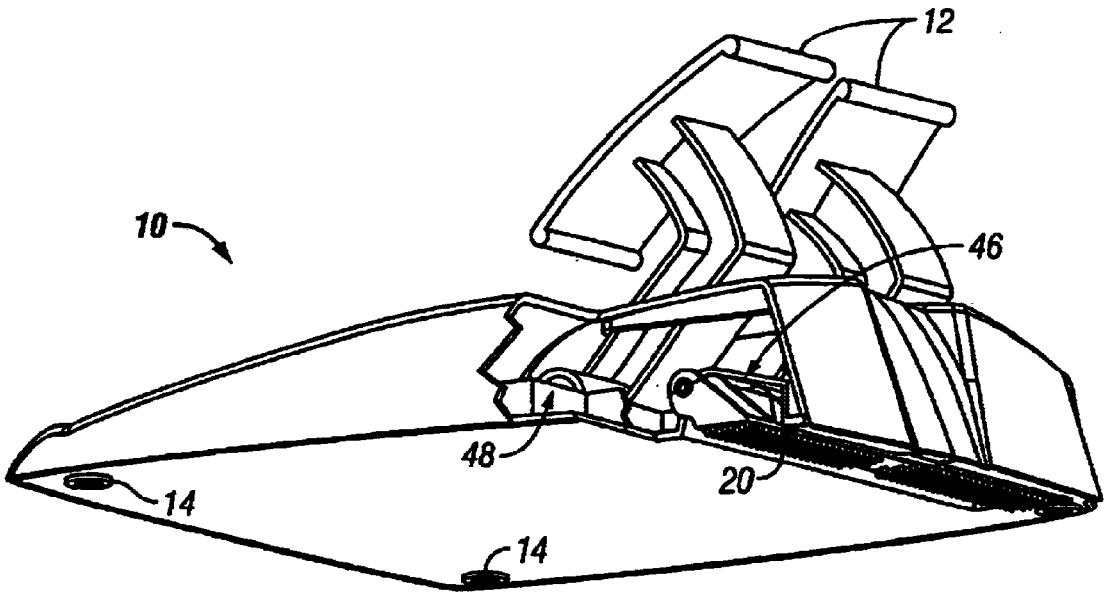
FIG. 7 is a partially cut-out perspective view of the pedal apparatus of FIG. 1 showing the assembly of the floor lock inside the cavity of the pedal apparatus.
Figure 8:
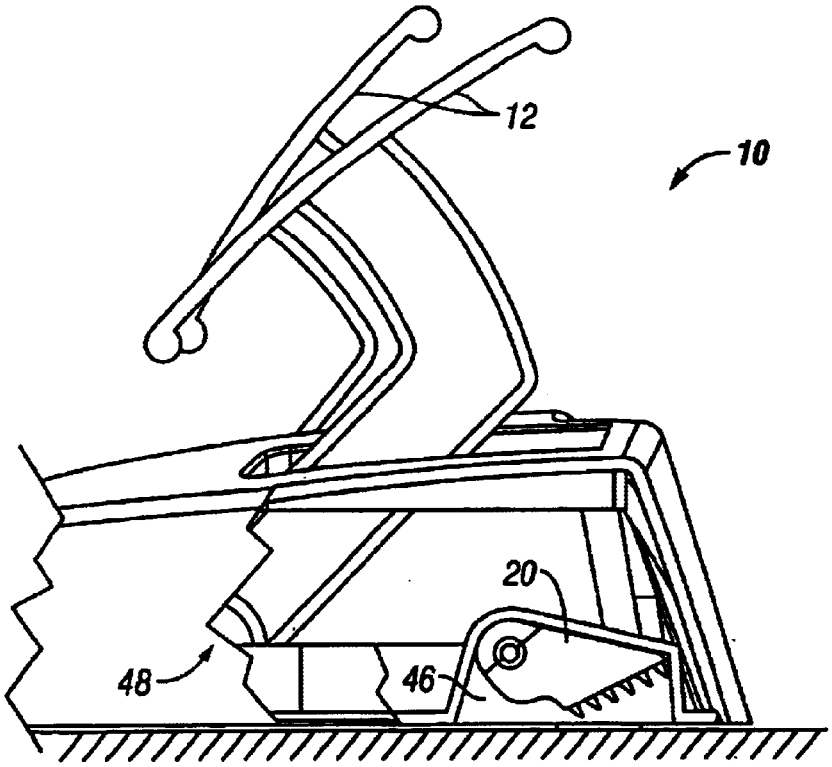
FIG. 8 is a partially cut-out elevational view of the pedal apparatus of FIG. 7.

As shown in FIG. 6, the pedal assembly 10 has a cavity 46 at the bottom for receiving the floor lock 20 by a hinge connection with the hinge points 22 disposed on opposite ends of the floor lock 20. FIGS. 7 and 8 show the floor lock 20 received into the cavity 46, desirably as far toward the front of the pedal assembly 10 (i.e., away from the user) as possible. The further to the front from the rotation point or pedal pivot 48 of the pedals 12 is the floor lock 20, the better the function of the floor locking device 20 because the force exerted on the pedals 12 is transferred more effectively through a moment about the pedal pivot 48 to push the floor lock 20 downward against the floor. If the floor lock 20 is located toward the back of the pedal assembly 10 instead (i.e., toward the user), the force transfer to the floor lock 20 from the pedals 12 is less effective. Indeed, if the floor lock 20 is located near the pedal pivot 48 or rearward of the pedal pivot 48, the moment about the pedal pivot 48 generated by applying forces on the pedals 12 may lift the floor lock 20 away from the floor instead of pushing it toward the floor. In some preferred embodiments, the hinge points 22 of the floor lock 20 are disposed forward of the pedal pivot 48.

Further, the longer the floor lock 20 extending across the widths of the pedals 12, the better the function of the floor lock 20 in terms of locking and stabilizing the pedal assembly 10. The long floor lock 20 minimizes rotation in a row direction about the center of the pedal assembly 10 as the user moves between the accelerator pedal and the brake pedal.

Figure 9A:
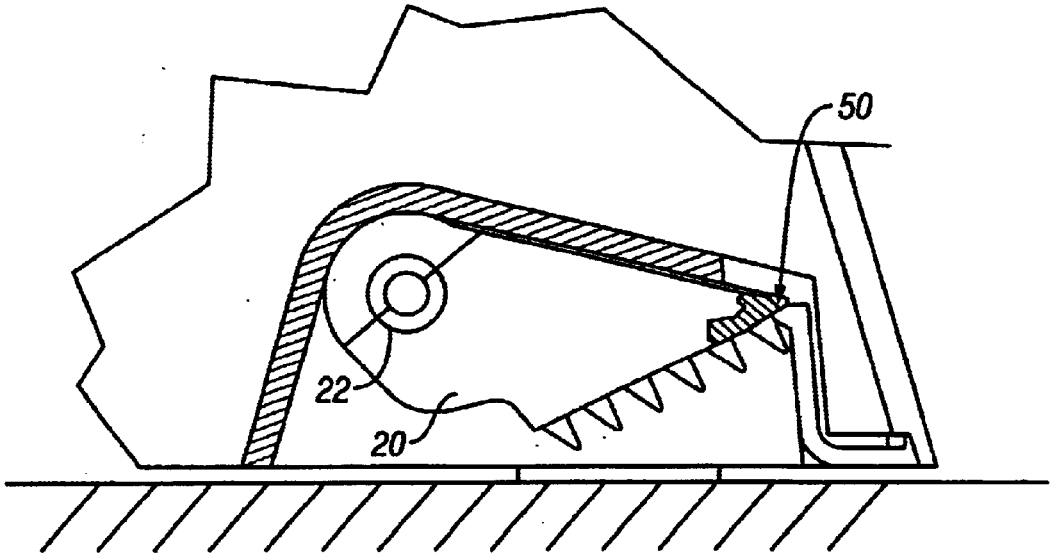
FIG. 9A is an elevational view of the pedal apparatus of FIG. 7 showing a latch for retaining the floor lock in the cavity of the pedal apparatus according to one embodiment.
Figure 9B:
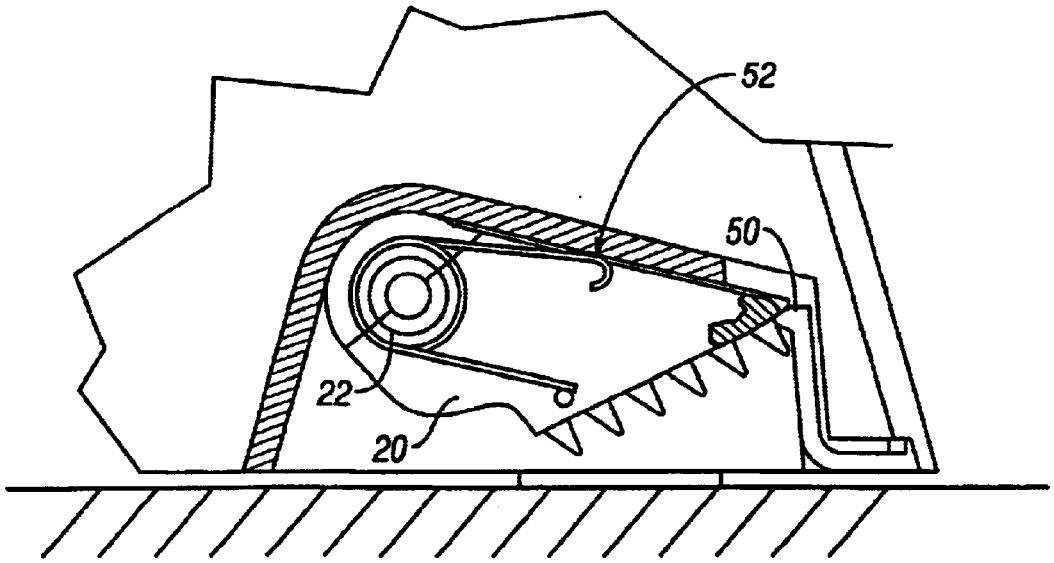
FIG. 9B is an elevational view of the pedal apparatus of FIG. 7 showing a biasing spring for the floor lock in the cavity of the pedal apparatus according to another embodiment.

As illustrated in FIG. 9A, the floor lock 20 is retained up inside the cavity 46 of the pedal assembly 10 in a recessed position by a latch 50. When the floor lock latch 50 is disengaged, the force of gravity (mg) acts through the mass center 42 (FIG. 5) of the floor lock 20 to lower the floor lock 20 to an engagement position into contact with the floor by creating a moment around the hinge axis extending between the hinge points 22 on opposite ends of the floor lock 20. In another embodiment as shown in FIG. 9B, a biasing spring 52 is coupled to the floor lock 20 to bias the floor lock 20 downward toward the floor. The biasing spring 52 is mounted around the hinge point 22 to rotate the floor lock 20 downward once the latch 50 is released. Other embodiments of the bias spring, which are not mounted about the pivot point 22, are possible.

Figure 10:
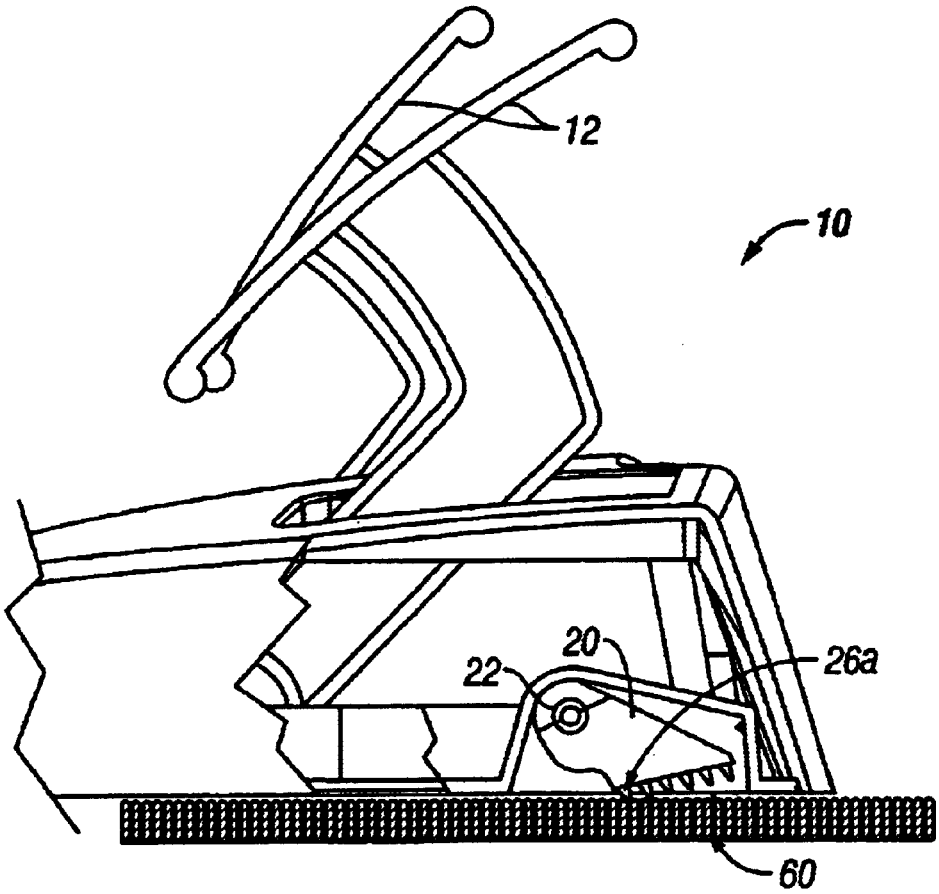
FIG. 10 is a partially cut-out elevational view of the pedal apparatus of FIG. 7 illustrating engagement between the leading row of teeth of the floor lock and a carpet floor.
Figure 11:
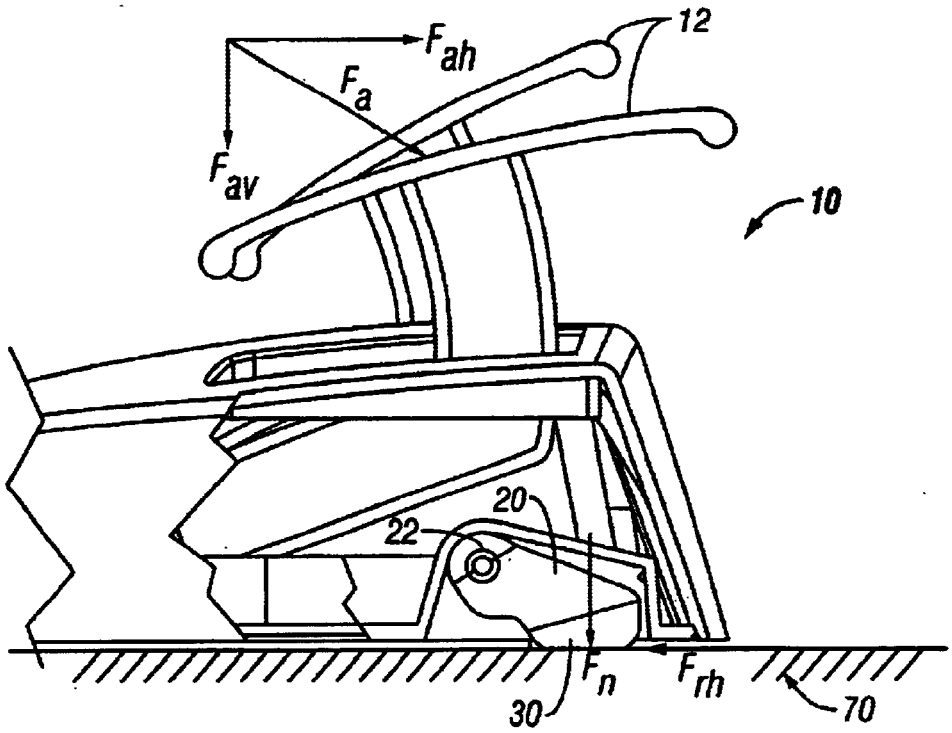
FIG. 11 is a partially cut-out elevational view of the pedal apparatus of FIG. 7 illustrating engagement between the pad of the floor lock and a non-carpeted floor.
Figure 12:
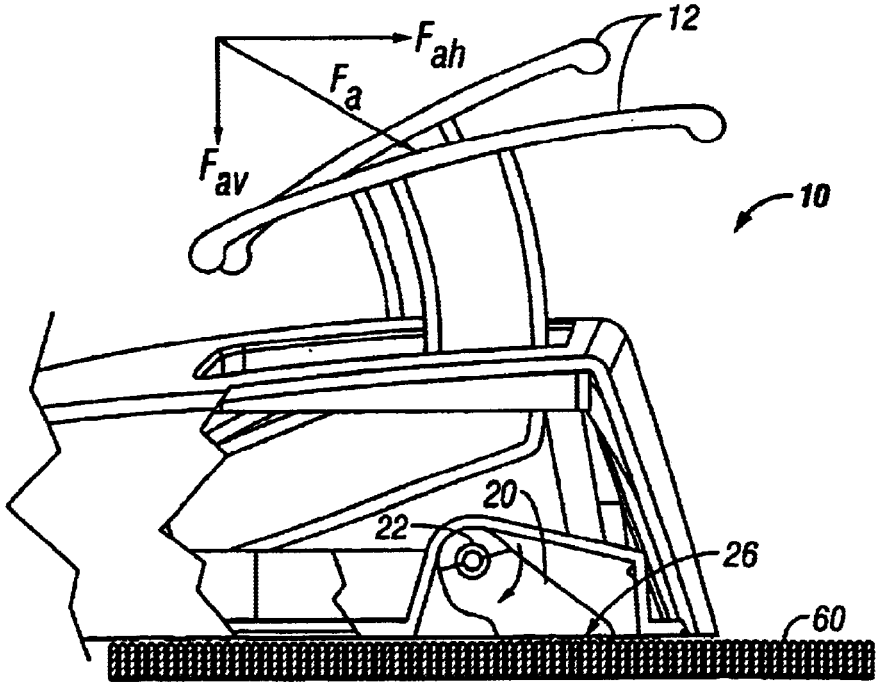
FIG. 12 is a partially cut-out elevational view of the pedal assembly of FIG. 7 illustrating engagement between the teeth of the floor lock and the carpet floor.

As shown in FIG. 10, the initial contact occurs between the leading row of teeth 26*a* and the floor 60. The weight mg (FIG. 5) of the floor lock 20 provides the initial interference with the floor 60 on which the input device 10 is resting. Due to the geometry of the floor lock's relatively short moment arm 44 (FIG. 5), a moment is created by the engagement of the teeth 26 with the carpet floor 60. Similarly, a moment or torque is created by the engagement of the rubber pad 30 with the non-carpeted floor 70, as illustrated in FIG. 11. As the applied force $F_a$ of the user increases, the resistance to movement (resistive force $F_{rh}$) also increases by engaging more teeth 26 with the carpet floor 60, as shown in FIG. 12 (or increasing the normal force $F_n$ on the rubber pad 30 as seen in FIG. 11). The moment or torque causes the rotatable floor lock 20 to further engage the floor (e.g., between the teeth and the carpet floor or between the pad and a non-carpeted floor).

Figure 13:
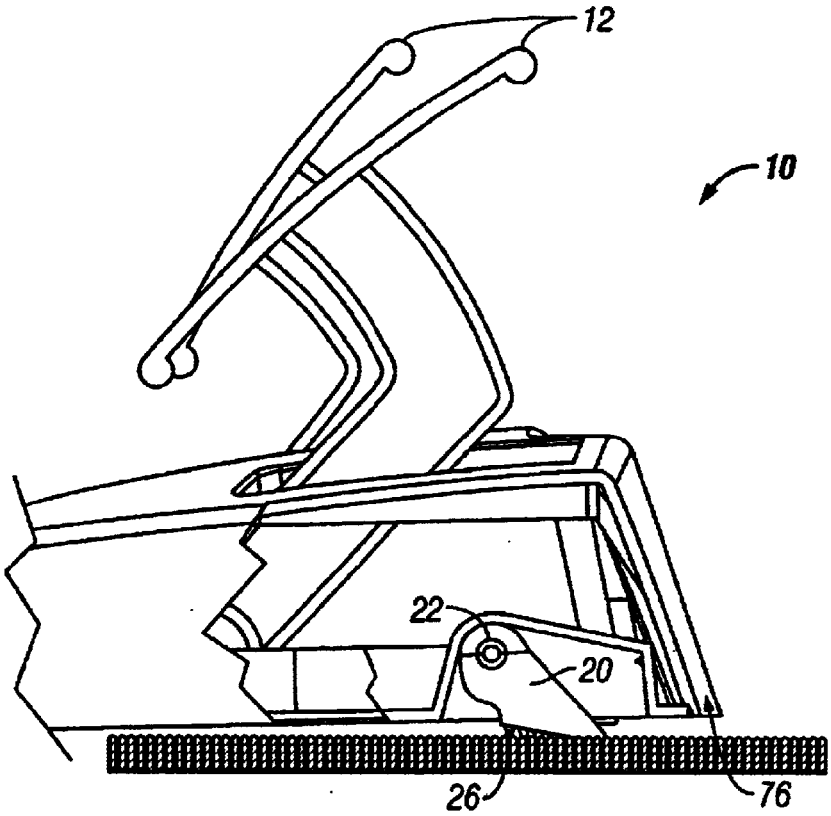
FIG. 13 is a partially cut-out elevational view of the pedal assembly of FIG. 7 illustrating engagement between the teeth of the rolled-under floor lock and the carpet floor.
Figure 14:
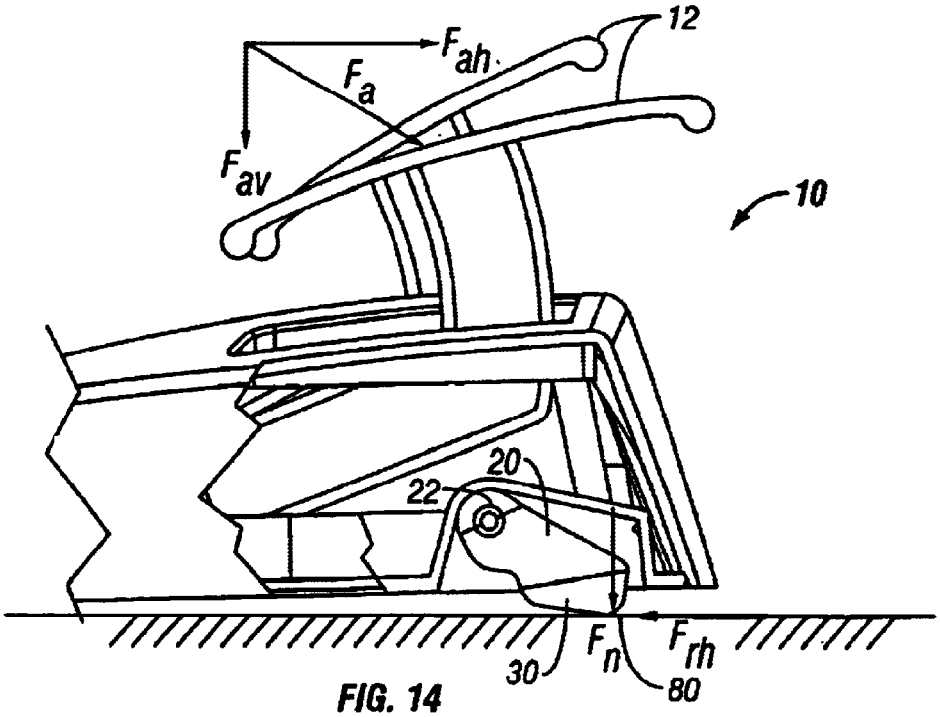
FIG. 14 is a partially cut-out elevational view of the pedal assembly of FIG. 7 illustrating engagement between the pad of the rolled-under floor lock and the non-carpeted floor.

The rotation of the floor lock 20 from the recessed position to the engagement position is not limited to the horizontal placement of the teeth 26 or rubber pad 30. In the engagement position of the floor lock 20, the teeth 26 or rubber pad 30 may be rotated beyond the horizontal plane, as illustrated in FIG. 13 and FIG. 14, respectively. This provides better grip or locking in certain situations. For instance, when the carpet is deep pile with a thick soft padding, the entire pedal assembly 10 can "rock" from front to back as the pedals 12 are pressed and released. This can cause the pedal assembly 10 to "walk" or "creep" away from the user. By allowing the floor lock 20 to rotate beyond the horizontal in the engagement position, the teeth 26 stay engaged with the carpet even if the back end 76 of the pedal assembly 10 rises up as a result of the sinking of the front end of the pedal assembly 10 into the soft, thick carpet, as seen in FIG. 13. Because the teeth 26 stay engaged with the carpet as the floor lock 20 adjusts its rotation in response to the rocking of the pedal assembly 10, creeping of the pedal assembly 10 away from the user is eliminated or minimized. In another example involving the use of a pad 30, a large force applied to the pedals 12 can cause the leading edge 80 of the pad 30 to roll under, thereby lifting the pedal assembly 10 slightly, as seen in FIG. 14. This creates a wedging resistance that is much higher than the horizontal resistance to movement by simple frictional contact between the pad 30 and the floor 70, due to the greater forces pushing the pad 30 against the floor 70 in the rolled under position.

Figure 15:
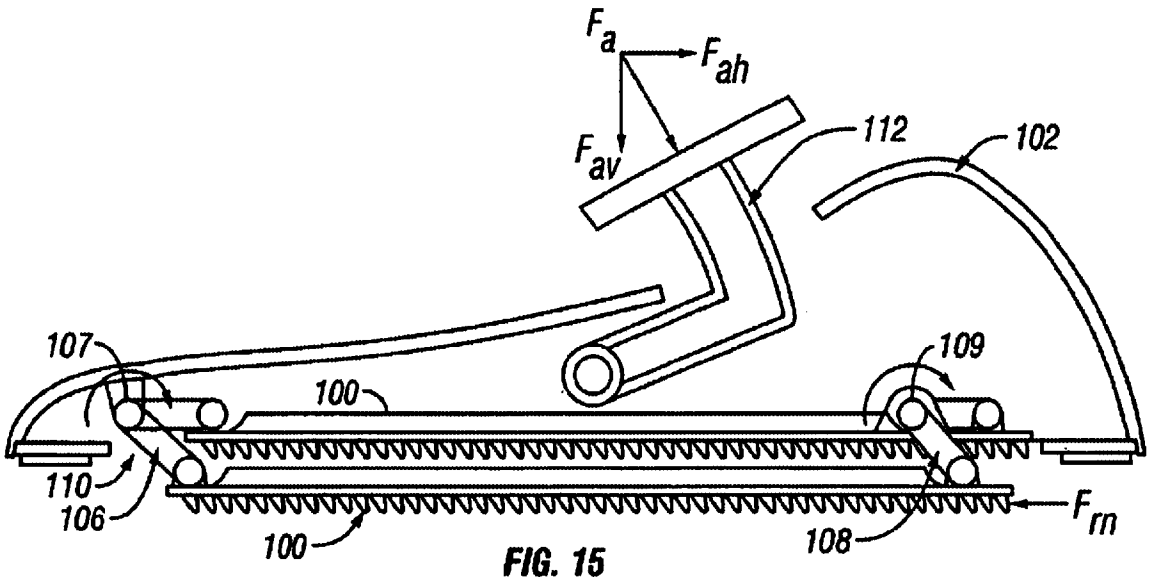
FIG. 15 is a sectional view of a pedal assembly employing a parallelogram mechanism for rotatably supporting a floor lock according to another embodiment of the present invention.
Figure 16:
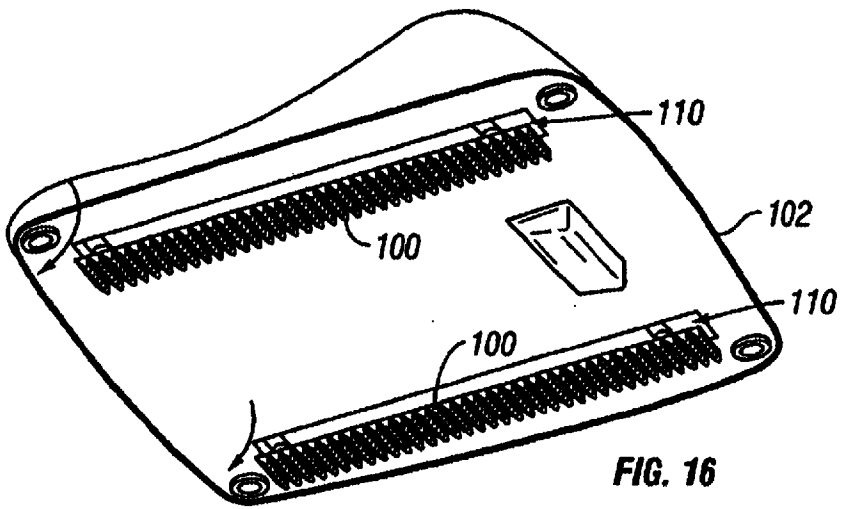
FIG. 16 is a lower perspective view of the pedal assembly of FIG. 15.

Another rotational mechanism for rotatably connecting a floor lock 100 to the body of a pedal assembly 102 is illustrated in FIG. 15. A parallelogram or four-bar linkage mechanism includes two parallel links 106, 108 rotatably connected to the body of the pedal assembly 102 at link joints or pivot locations 107, 109, respectively. The parallel links 106, 108 rotate between a recessed position inside a cavity 110 of the pedal assembly 102 and an engagement position 100' for engaging the floor. FIG. 16 shows two such floor locks 100 disposed near opposite side edges of the pedal assembly 102, spaced in the direction across the accelerator and brake pedals 112. The floor lock 100 improves the retention of the pedal assembly 102 on the floor by increasing the gripping area (i.e., contact between the teeth or pad and the floor) and providing a resistance against side-to-side tilting or tipping forces produced when the user moves between the accelerator pedal and the brake pedal, as a result of spacing the two floor locks 100 across the accelerator and brake pedals 112.

The four-bar linkage mechanism allows the floor lock 100 to rotate downward from the recessed position to the engagement position in response to the horizontal component $F_{ah}$ of the force $F_a$ applied to the pedals 112. A reaction force created by the interference of the floor lock 100 with the floor generates a torque about each of the link joints 107, 109, causing the floor lock 110 to further engage the floor (e.g., between the teeth and the carpet floor or between the pad and a non-carpeted floor). As the user applies a greater force to the pedals 112, the linkage generates a higher gripping force between the floor lock 100 and the floor.

Figure 17:
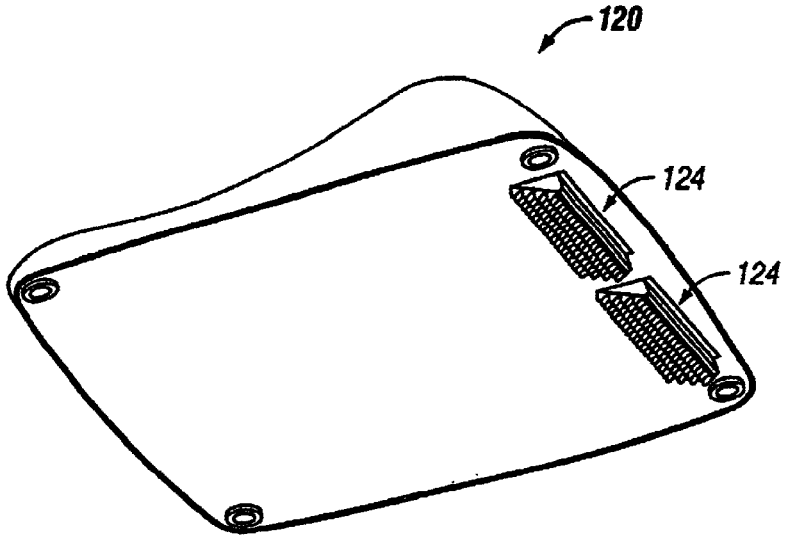
FIG. 17 is a lower perspective view of a pedal assembly having a pair of spaced floor locks according to another embodiment of the present invention.
Figure 18:
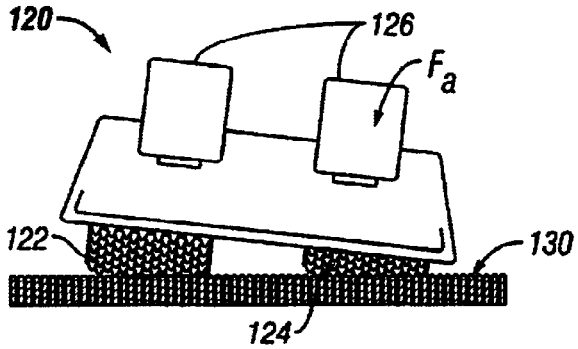
FIG. 18 is an elevational view of the pedal assembly of FIG. 17 illustrating tilting of the pedal assembly to the right.
Figure 19:
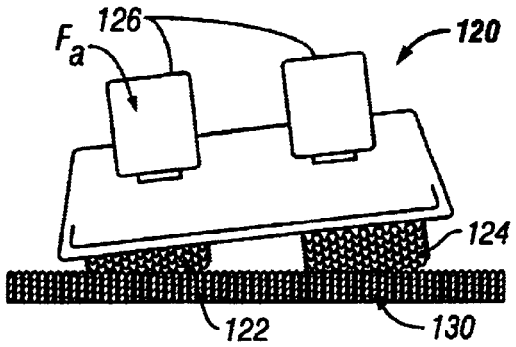
FIG. 19 is an elevational view of the pedal assembly of FIG. 17 illustrating tilting of the pedal assembly to the left.

In another embodiment as shown in FIGS. 17–19, the pedal assembly 120 includes a pair of floor locks 122, 124 disposed on the right and left sides near the forward edge of the pedal assembly 120. Each floor lock 122, 124 may be similar in construction to the floor lock 20 of FIGS. 2–14. In some embodiments, the left floor lock 122 extends to the left of the left pedal and the right floor lock 124 extends to the right of the right pedal for increased stability. In essence, the floor lock 20 of FIGS. 2–14 is split into two separate floor locks 122, 124. This configuration increases the resistance against side-to-side tipping of the pedal assembly 120 when the user moves the foot from one pedal 126 to another. The left and right floor locks 122, 124 provide independent rotation of the left grip and right grip onto the floor 130. Each floor lock reacts independently to the forces exerted on the pedal assembly 120. When the force $F_a$ is applied to the accelerator pedal on the right as shown in FIG. 18, the pedal assembly 120 tips to the right. The left floor lock 122 rotates downward more than the right floor lock 124 to compensate for this tipping movement and engage the floor 130, thereby keeping the pedal assembly 120 firmly in contact with the floor 130. Conversely, when the force $F_a$ is applied to the brake pedal on the left as shown in FIG. 19, the pedal assembly 120 tips to the left. The right floor lock 124 rotates downward more than the left floor lock 122 to compensate for this tipping movement and engage the floor 130, thereby keeping the pedal assembly 120 firmly in contact with the floor 130 across the width of the assembly 120.

In other embodiments, more than two floor locks may be provided. The floor locks may be arranged in different manners. For instance, the pedals may be oriented differently to produce horizontal force components in different directions. The floor locks can be arranged accordingly to counter the horizontal force components to maintain the pedal assembly in place during play. The floor locks may be rotatable around different axes that are parallel or nonparallel with each other.

The above-described arrangements of apparatus and methods are merely illustrative of applications of the principles of this invention and many other embodiments and modifications may be made without departing from the spirit and scope of the invention as defined in the claims. For instance, the floor lock may have other configurations and shapes, and may be connected to the input device by different mechanisms in other embodiments. The scope of the invention should, therefore, be determined not with reference to the above description, but instead should be determined with reference to the appended claims along with their full scope of equivalents.

What is claimed is:

1. An input device with a non-permanent floor mount, the input device comprising:

a user manipulable object movably coupled to a body of the input device which is configured to be placed on a floor, the user manipulable object being movable by a user applying a force thereon having a force component in a forward direction along the floor; and a floor lock movably connected to the body of the input device and having a contact surface for engaging the floor to substantially prevent movement of the input device in the forward direction along the floor, the floor lock being configured to move with respect to the body of the input device in a downward direction toward the floor and a rearward direction opposite from the forward direction in response to the force applied by the user on the user manipulable object having the force component in the forward direction along the floor;

wherein the floor lock is rotatably connected to the body of the input device to rotate in the downward direction and the rearward direction in response to the force applied by the user having the force component in the forward directions, wherein the user manipulable object comprises one or more pedals rotatably mounted on the body of the input device along a pedal pivot, and wherein the floor lock is disposed at least partially in a cavity of the body of the input device in a recessed position.

2. The input device of claim 1 wherein the floor lock is rotatably connected to the body of the input device by a hinge.

3. The input device of claim 1 wherein the contact surface of the floor lock comprises a plurality of teeth.

4. The input device of claim 1 wherein the contact surface of the floor lock comprises a rubber pad.

5. The input device of claim 4 wherein the rubber pad is removably coupled to the floor lock and is removable to expose another contact surface having a plurality of teeth.

6. The input device of claim 1 wherein the contact surface of the floor lock is initially slanted upward in the forward direction with respect to the floor prior to application of the force having the force component in the forward direction along the floor, and wherein the floor lock is rotatable in the downward direction and the rearward direction to position the contact surface more parallel to the floor upon application of the force.

7. The input device of claim 6 wherein the floor lock is rotatable further in the downward direction and the rearward direction to position the contact surface to be slanted downward in the forward direction with respect to the floor upon application of a sufficient amount of the force.

8. The input device of claim 1 wherein the floor lock is rotatably connected to the body of the input device along a floor lock pivot which is disposed forward of the pedal pivot.

9. The input device of claim 1 wherein a latch releasably supports the floor lock in the recessed position and is actuatable to permit the floor lock to move away from the cavity of the body.

10. The input device of claim 1 further comprising a biasing member coupled with the floor lock to bias the floor lock in the downward direction toward the floor.

11. The input device of claim 1 wherein the user manipulable object comprises a plurality of pedals disposed along a width of the body of the input device, the width extending from a left side to a right side of the body, and wherein the floor lock is disposed along the width of the body extending to the left of the plurality of pedals and to the right of the plurality of the pedals.

12. The input device of claim 1 wherein the floor lock is rotatably connected to the body of the input device by a four-bar linkage.

13. The input device of claim 1 comprising a plurality of floor locks distributed along a width of the body of the input device, the width extending from a left side to a right side of the body, the floor locks being independently movable with respect to the body of the input device.

14. The input device of claim 1, wherein the user manipulable object is movable by the user applying a force thereon having force components in a plurality of directions including the forward direction along the floor, and wherein the input device comprises a plurality of floor locks each movably connected to the body of the input device and having a contact surface for engaging the floor to substantially prevent movement of the input device in the plurality of directions along the floor, each floor lock being configured to move with respect to the body of the input device in a downward direction toward the floor and a resisting direction opposite from each of the plurality of directions along the floor in response to the force applied by the user on the user manipulable object having the force components in the plurality of directions along the floor.

15. An input device with a non-permanent floor mount, the input device comprising:

a user manipulable object movably coupled to a body of the input device which is configured to be placed on a floor, the user manipulable object being movable by a user applying a force thereon having a force component in a forward direction along the floor; and a floor lock movably connected to the body of the input device and having a contact surface for engaging the floor to substantially prevent movement of the input device in the forward direction along the floor, the floor lock being configured to move with respect to the body of the input device in a downward direction toward the floor and a rearward direction opposite from the forward direction in response to the force applied by the user on the user manipulable object having the force component in the forward direction along the floor;

wherein the contact surface of the floor lock comprises a rubber pad, and wherein the rubber pad is removably coupled to the floor lock and is removable to expose another contact surface having a plurality of teeth, wherein the user manipulable object comprises one or more pedals rotatably mounted on the body of the input device alone a pedal pivot, and wherein the floor lock is disposed at least partially in a cavity of the body of the input device in a recessed position.

16. An input device with a non-permanent floor mount, the input device comprising:

a user manipulable object movably coupled to a body of the input device which is configured to be placed on a floor, the user manipulable object being movable by a user applying a force thereon having a force component in a forward direction along the floor; and a floor lock movably connected to the body of the input device and having a contact surface for engaging the floor to substantially prevent movement of the input device in the forward direction along the floor, the floor lock being configured to move with respect to the body of the input device in a downward direction toward the floor and a rearward direction opposite from the forward direction in response to the force applied by the user on the user manipulable object having the force component in the forward direction along the floor;

wherein the contact surface of the floor lock is initially slanted upward in the forward direction with respect to the floor prior to application of the force having the force component in the forward direction along the floor, and wherein the floor lock is rotatable in the downward direction and the rearward direction to position the contact surface more parallel to the floor upon application of the force, wherein the user manipulable object comprises one or more pedals rotatably mounted on the body of the input device along a pedal pivot, and wherein the floor lock is disposed at least partially in a cavity of the body of the input device in a recessed position.

17. The input device of claim 16 wherein the floor lock is rotatable further in the downward direction and the rearward direction to position the contact surface to be slanted downward in the forward direction with respect to the floor upon application of a sufficient amount of the force.

18. An input device with a non-permanent floor mount, the input device comprising:

a user manipulable object movably coupled to a body of the input device which is configured to be placed on a floor, the user manipulable object being movable by a user applying a force thereon having a force component in a forward direction along the floor; and a floor lock movably connected to the body of the input device and having a contact surface for engaging the floor to substantially prevent movement of the input device in the forward direction along the floor, the floor lock being configured to move with respect to the body of the input device in a downward direction toward the floor and a rearward direction opposite from the forward direction in response to the force applied by the user on the user manipulable object having the force component in the forward direction along the floor;

wherein the user manipulable object comprises one or more pedals rotatably mounted on the body of the input device along a pedal pivot, and wherein the floor lock is rotatably connected to the body of the input device along a floor lock pivot which is disposed forward of the pedal pivot, and wherein the floor lock is disposed at least partially in a cavity of the body of the input device in a recessed position.

19. The input device of claim 18 wherein the floor lock is rotatably connected to the body of the input device to rotate in the rearward direction in response to the force applied by the user having the force component in the forward direction.

20. An input device with a non-permanent floor mount, the input device comprising:

a user manipulable object movably coupled to a body of the input device which is configured to be placed on a floor, the user manipulable object being movable by a user applying a force thereon having a force component in a forward direction along the floor; and a floor lock movably connected to the body of the input device and having a contact surface for engaging the floor to substantially prevent movement of the input device in the forward direction along the floor, the floor lock being configured to move with respect to the body of the input device in a downward direction toward the floor and a rearward direction opposite from the forward direction in response to the force applied by the user on the user manipulable object having the force component in the forward direction along the floor;

wherein the floor lock is disposed at least partially in a cavity of the body of the input device in a recessed position, and wherein a latch releasably supports the floor lock in the recessed position and is actuatable to permit the floor lock to move away from the cavity of the body, and wherein the user manipulable object comprises one or more pedals rotatably mounted on the body of the input device alone a pedal pivot.

21. The input device of claim 20 wherein the floor lock is rotatably connected to the body of the input device by a hinge.

22. An input device with a non-permanent floor mount, the input device comprising:

a user manipulable object movably coupled to a body of the input device which is configured to be placed on a floor, the user manipulable object being movable by a user applying a force thereon having a force component in a forward direction along the floor;

a floor lock movably connected to the body of the input device and having a contact surface for engaging the floor to substantially prevent movement of the input device in the forward direction along the floor, the floor lock being configured to move with respect to the body of the input device in a downward direction toward the floor and a rearward direction opposite from the forward direction in response to the force applied by the user on the user manipulable object having the force component in the forward direction along the floor; and a biasing member coupled with the floor lock to bias the floor lock in the downward direction toward the floor during application of the force by the user on the user manipulable object having the force component in the forward direction along the floor, wherein the user manipulable object comprises one or more pedals rotatably mounted on the body of the input device along a pedal pivot, and wherein the floor lock is disposed at least partially in a cavity of the body of the input device in a recessed position.

23. The input device of claim 22 wherein the floor lock is rotatably connected to the body of the input device by a hinge.

* * * * *

UNITED STATES PATENT AND TRADEMARK OFFICE

CERTIFICATE OF CORRECTION

PATENT NO. : 6,886,427 B2
DATED : May 3, 2005
INVENTOR(S) : McVicar

It is certified that error appears in the above-identified patent and that said Letters Patent is hereby corrected as shown below:

Column 7,
Line 41, correct "directions" to -- direction --.

Signed and Sealed this

Twentieth Day of December, 2005

JON W. DUDAS
*Director of the United States Patent and Trademark Office*